United States Patent [19]

Salas

[11] 4,178,736

[45] Dec. 18, 1979

[54] HOUSING MODULE AND SPACE FRAME

[76] Inventor: Frank D. Salas, 4200 Alhambra Cir., Coral Gables, Fla. 33146

[21] Appl. No.: 888,498

[22] Filed: Mar. 20, 1978

Related U.S. Application Data

[63] Continuation-in-part of Ser. No. 655,504, Feb. 5, 1976, abandoned.

[51] Int. Cl.[2] ..... E04H 12/00

[52] U.S. Cl. ..... 52/648; 52/655; 52/693

[58] Field of Search ..... 52/638, 648, 655, 693, 52/79.1, 79.12, 643, 650, 690

[56] References Cited

U.S. PATENT DOCUMENTS

| | | | |
|---|---|---|---|
| 2,140,283 | 12/1938 | Faber | 52/648 X |
| 3,965,626 | 6/1976 | Johnson | 52/648 X |
| 3,978,635 | 9/1976 | Theault | 52/693 |

FOREIGN PATENT DOCUMENTS

| | | | |
|---|---|---|---|
| 1461366 | 12/1966 | France | 52/650 |
| 946460 | 1/1964 | United Kingdom | 52/648 |

*Primary Examiner*—Carl D. Friedman
*Attorney, Agent, or Firm*—Spencer & Kaye

[57] ABSTRACT

A rigid housing module is formed of a plurality of module walls connected to one another at a predetermined angle other than 0° and 180°. Each module wall has an assembly of identical planar structural elements each having the shape of a trapezoid. Each element has a relatively long inner side, a relatively short outer side and two diagonal sides constituting, respectively, the long and short bases and the two non-parallel sides of the trapezoid. The elements of each assembly are arranged in a juxtapositioned series wherein all inner and outer sides are parallel to one another and wherein adjoining elements are connected to one another alternatingly along adjoining outer sides and along adjoining inner sides and further wherein the elements are oriented at a predetermined oblique angle with respect to an inner assembly plane in which the inner sides lie. Adjoining module walls are connected to one another along adjoining, parallel-extending diagonal sides of the elements forming two assemblies that constitute two adjoining module walls. Each outer side and each inner side in any one assembly continues as an inner side and as an outer side, respectively, in any adjoining assembly. Each module wall further has a rigid transverse connecting arrangement extending along each line of intersection formed between the inner assembly planes of the assemblies. Each rigid transverse connecting arrangement is attached to each inner side it traverses along the respective line of intersection.

22 Claims, 10 Drawing Figures

FIG. 1
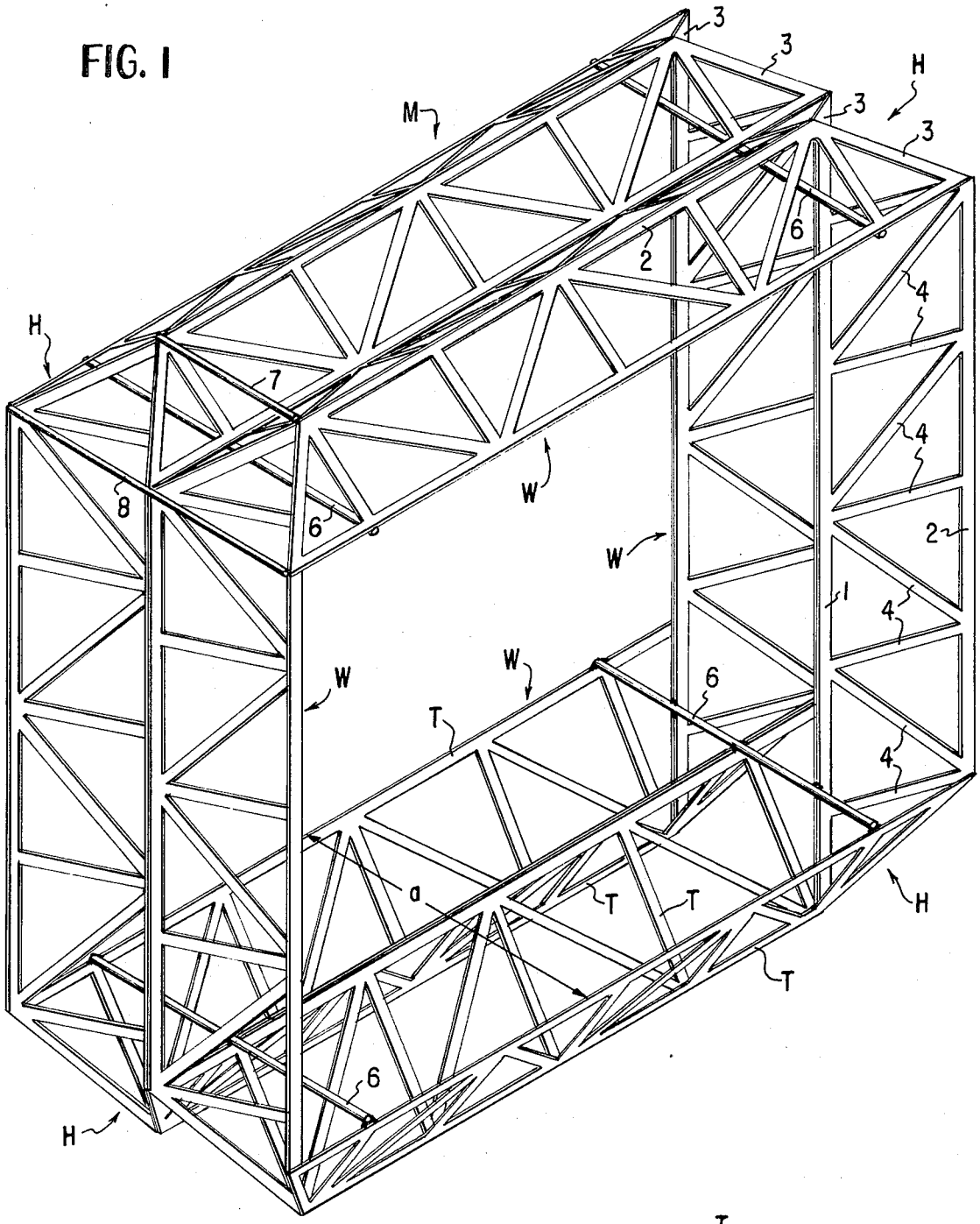
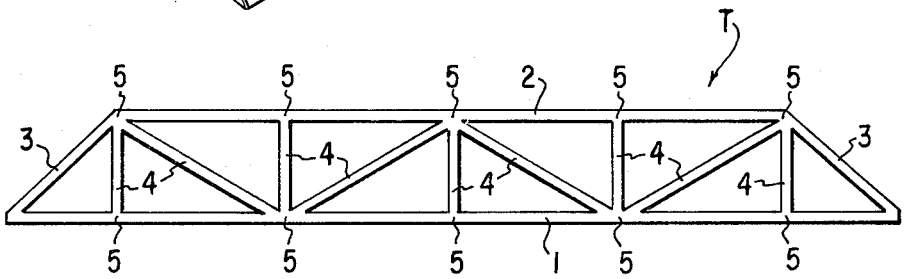
FIG. 2

FIG. 3
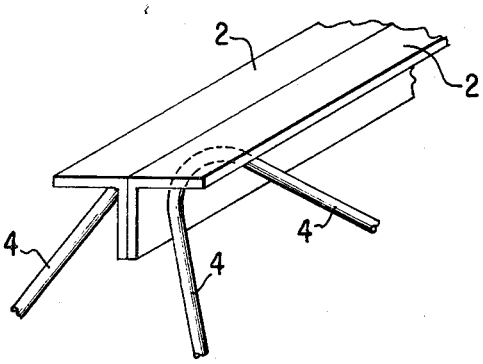
FIG. 4
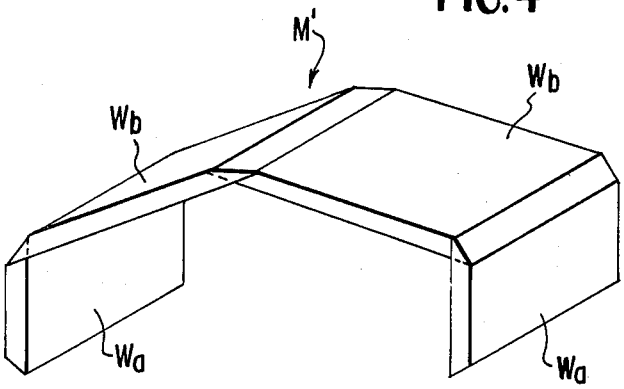
FIG. 7
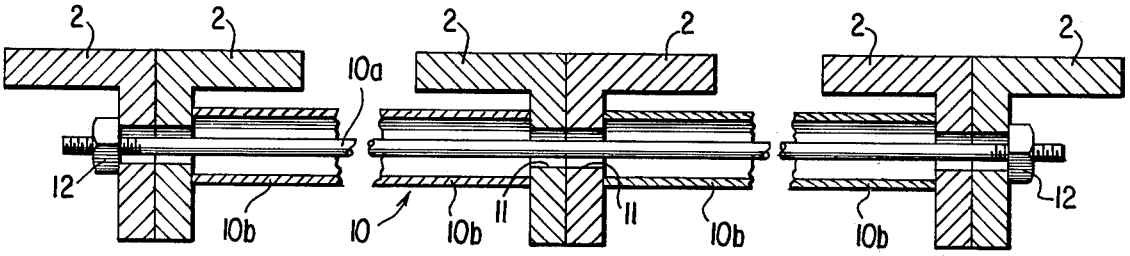
FIG. 8
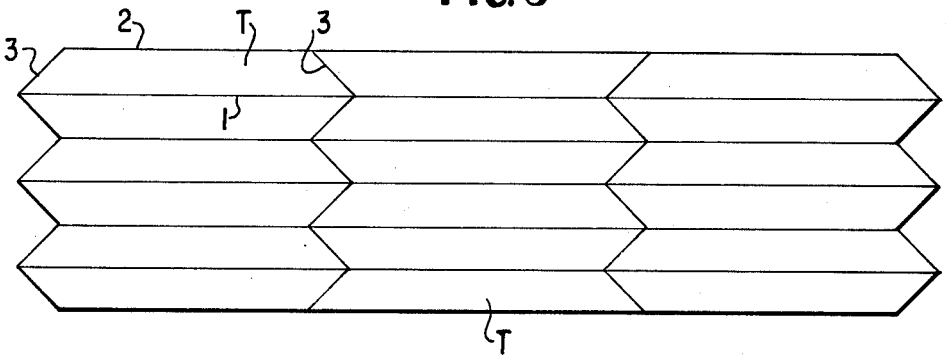
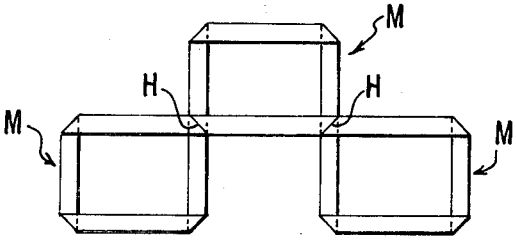
FIG. 9
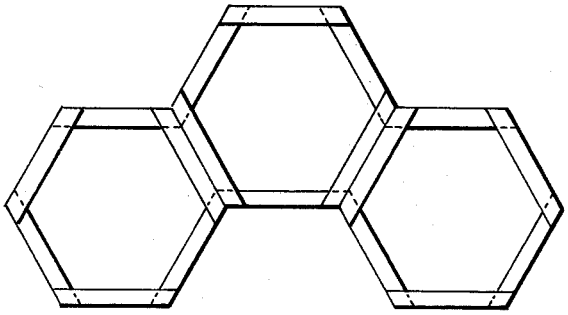
FIG. 10

HOUSING MODULE AND SPACE FRAME

CROSS-REFERENCE TO RELATED APPLICATION

This is a continuation-in-part of application Ser. No. 655,504, filed Feb. 5th, 1976, now abandoned.

BACKGROUND OF THE INVENTION

This invention relates to a rigid housing or shelter module for providing individual or multiple living units or other enclosed useful space. More particularly, the invention relates to the particular skeleton structure of the module which, according to requirements, may subsequently be covered with skin faces or tiles and may be otherwise complemented with conventional fixtures to serve the intended purpose.

The use of three-dimensional modules as a means to prefabricate living units has long been used in building construction. These modules have been built of wood, metals, casting materials, such as concrete and, more recently, reinforced plastics.

In conventional wood and metal modules, the structure consists of a combination of ribs or joists to which the skin is eventually fastened. Concrete and plastic modules are, as a rule, formed as a continuous shell. The manipulation, transportation and erection of these modules is difficult and time consuming either because of their weight (as in the case of concrete) or because the general instability of the module skeleton results in a tendency to rack and in an overall lack of rigidity (particularly in the case of wood and metal modules). A principal reason for the lack of rigidity is the inferior stability particularly at the junction between the adjoining module walls.

With the exception of concrete modules in which sufficient strength can be built in, the modules normally require a supporting frame which embraces them before the final rigidizing connections (for example, with other adjacent modules in the building structure) are made. Concrete modules, on the other hand, while not needing such embracing frame supports, require elaborate connections which are both costly to make and bulky to use.

It is another common shortcoming encountered in the construction of conventional modules that electrical and mechanical systems can be integrated in the module structure only with difficulty. The reason is the lack of space—particularly the lack of a continuous space—within the skeleton forming the module or module walls.

Heretofore, prefabricated planar structural elements such as panels or trusses have not been used as components of rigid housing modules. The reason is seen in difficulties encountered both in the bracing of such planar structural elements in a direction perpendicular to the plane in which they carry the load and in ensuring the sufficient stability (fixity) at those locations of module walls which serve as connecting portions with adjacent module walls. Statically, these locations are the points of support for the module wall. Without such a stability (fixity) of the support locations, the module would be unstable. In conventional systems of planar structural elements, such as truss systems, extensive temporary bracing has been required until decks or skins, usually in combination with permanent bridging members, provide lateral bracing for stability. In these truss systems very seldom is stability (fixity) attained at the points of support.

SUMMARY OF THE INVENTION

It is therefore an object of the invention to provide an improved housing module which can be erected without scaffolding or falsework, which provides uninterrupted air chambers within the module walls in perpendicular directions, which has an improved stability in the connecting zones between module walls (that is, at the points of support of the module walls) and which offers an increased versatility in selecting a desired mutual stacked relationship of several modules in a building structure, or cantilevering of a core structure.

These objects and others to become apparent as the specification progresses, are accomplished by the invention, according to which, briefly stated, the rigid housing module is formed of a plurality of module walls connected to one another at a predetermined angle other than 0° and 180°. Each module wall has an assembly of identical planar structural elements each having the shape of a trapezoid. Each element has a relatively long inner side, a relatively short outer side and two diagonal sides constituting, respectively, the long and short bases and the two non-parallel sides of the trapezoid. The elements of each assembly are arranged in a juxtapositioned series wherein all inner and outer sides are parallel to one another and wherein adjoining elements are connected to one another alternatingly along adjoining outer sides and along adjoining inner sides and further wherein the elements are oriented at a predetermined oblique angle with respect to an inner assembly plane in which the inner sides lie. Adjoining module walls are connected to one another along adjoining, parallel-extending diagonal sides of the elements forming two assemblies that constitute two adjoining module walls. Each outer side and each inner side in any one assembly continues as an inner side and as an outer side, respectively, in any adjoining assembly. Each module wall further has a rigid transverse connecting arrangement extending along each line of intersection formed between the inner assembly planes of the assemblies. Each rigid transverse connecting arrangement is attached to each inner side it traverses along the respective line of intersection.

BRIEF DESCRIPTION OF THE DRAWINGS

FIG. 1 is a schematic perspective view of a preferred embodiment of the invention.

FIG. 2 is a schematic side elevational view of one of a plurality of components incorporated in the structure according to FIG. 1.

FIG. 3 is a perspective detail of a practical embodiment.

FIG. 4 is a schematic perspective view of an open module structured according to the invention.

FIG. 7 is a sectional view of a practical embodiment of one detail of the structure shown in FIG. 5.

FIG. 8 is a schematic plan view of a plurality of interconnected components in a two-dimensional arrangement.

FIGS. 9 and 10 are schematic side elevational views illustrating examples of stacking possibilities of rectangular and, respectively, hexagonal modules constructed according to the invention.

DETAILED DESCRIPTION OF THE PREFERRED EMBODIMENTS

Figure 5:
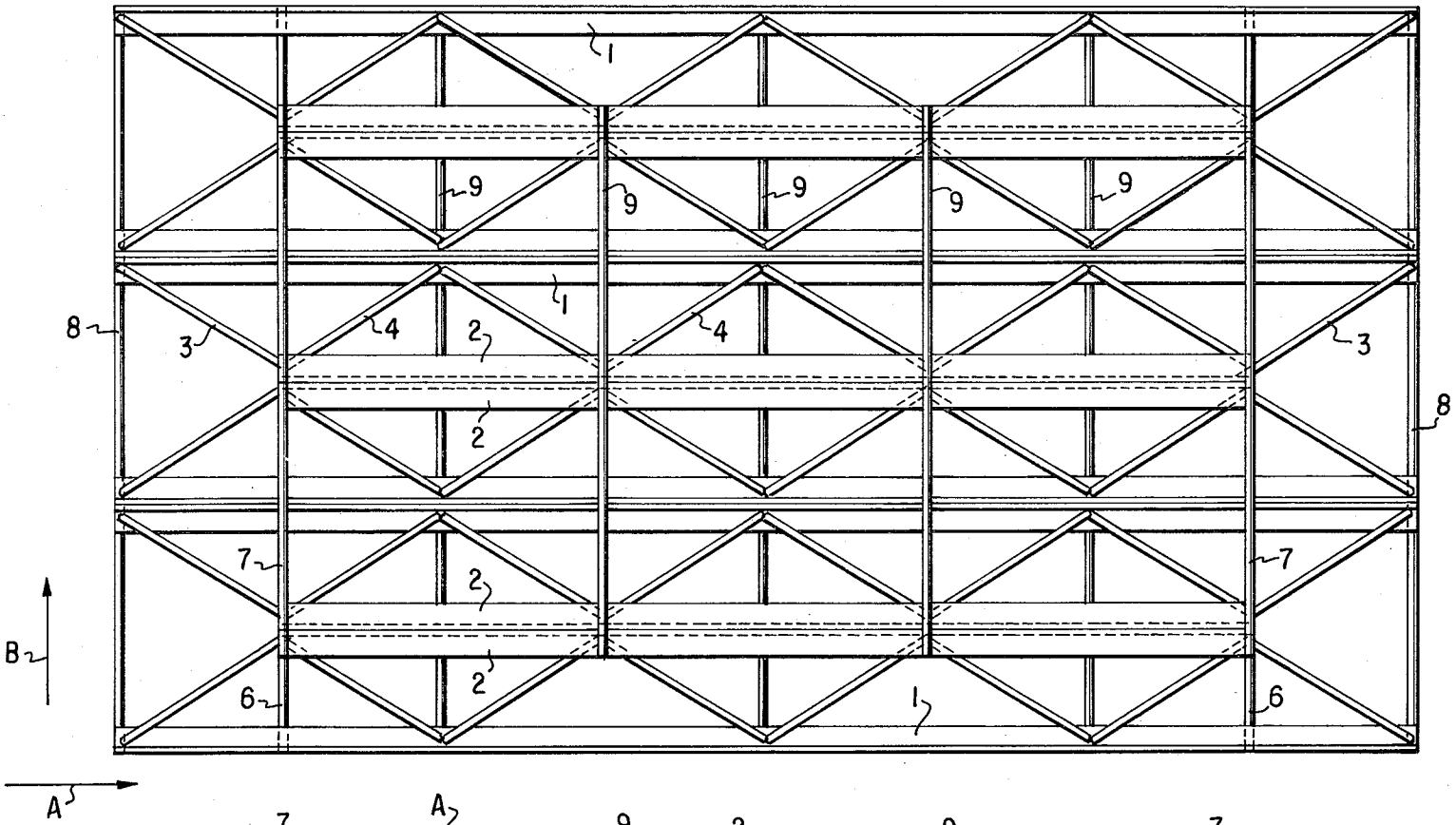
FIG. 5 is a top plan view of a space frame constituting, a preferred embodiment of one wall of the module shown in FIG. 1.

Turning now to FIG. 1, there is illustrated a closed module M which has four walls W connected to one another to form, when viewed perimetrically, a continuous wall face. In this example, the module walls W adjoin one another at an angle of 90°. Each wall W is formed of an assembly of planar structural elements, such as trusses T arranged in an accordion-like (zigzag) relationship to one another. Within each truss assembly constituting a particular module wall W, the trusses T are of identical, trapezoidal configuration.

Also referring now to FIG. 2 which illustrates one truss T in side elevation, each truss T has a relatively long chord 1 and a relatively short chord 2 constituting, respectively, the long and the short bases of the trapezoid. At their ends, the long and short chords 1 and 2 are interconnected by opposite diagonal chords 3 which, in turn, constitute the non-parallel sides of the trapezoid. Viewing now the truss assembly as constituting a wall W of the module M, the short chords 2 are always at the external side of the wall W, whereas the long chords 1 always extend at the internal side of the wall W. For this reason, the long chords 1 are designated hereafter as "inner" chords, whereas the short chords 2 are termed as "outer" chords. The four chords of each truss thus bound a quadrilateral (trapezoidal) area which defines the truss plane.

In each truss T, the quadrilateral area defined by the inner chord 1, the outer chord 2 and the two diagonal chords 3 is occupied by a latticework constituted by web members 4. Each web member 4 connects the inner chord 1 with the outer chord 2. The connecting points between any web 4 and the chords 1 and 2 are panel points 5. While in each truss shown in FIGS. 1 and 2 the adjoining webs are at an oblique angle with respect to one another, it is feasible to use trusses in which all the webs extend parallel to one another.

As seen in FIG. 1, the zigzag-arranged trusses T of the truss assembly constituting one module wall W continue in zigzag-arranged trusses of a similar truss assembly constituting the adjoining wall W. In each truss assembly, the trusses T are arranged in a juxtapositioned series: all inner and outer chords 1 and 2 are parallel to one another. The juxtapositioned trusses are in a back-to-back arrangement, that is, viewing any particular truss, its outer chord 2 is attached to an outer chord 2 of the one flanking truss and its inner chord 1 is attached to the inner chord 1 of the other flanking truss. In this connection it is noted that in any truss assembly each outer chord and each inner chord may be common to two adjoining trusses, likewise, adjoining diagonal chords of two truss assemblies of adjoining walls can be replaced by a single diagonal chord. This simplifies the structure and reduces its weight.

The truss assembly of one module wall W continues in a truss assembly of the adjoining module wall W such that trusses T of the one truss assembly are connected to continuing trusses T of the other truss assembly at the juxtapositioned, parallel-extending diagonal chords 3. The transitional zone from one truss assembly to another is hereafter also referred to as the hunch H. The diagonal chords 3 in each transitional zone (hunch H) define a hunch plane which cuts off each corner of the module thus giving the corner zones a chamferred configuration. Considering the truss T shown in FIG. 2 as a member of a truss assembly forming a module wall, the two hunch planes at either end of the truss would contain the respective diagonal chord 3 and would be perpendicular to the sheet of the drawing. It is a further characteristic of each hunch H that each inner chord 1 in one truss assembly (forming one particular module wall W) continues as an outer chord 2 in the adjoining truss assembly (constituting the adjoining module wall W). Conversely, each outer chord 2 in one particular truss assembly continues as the inner chord 1 of the adjoining truss assembly. The inner and outer chords which thus constitute continuations of one another lie in a plane which is perpendicular to the width dimension a of the module M. If it is desired to provide an overhang module wall it is feasible to linearly prolong (cantelever) the inner and/or the outer chords of a truss assembly beyond the connecting points with the respective chords of an adjoining truss assembly. This is particularly advantageous in a module wall which forms the module roof.

Considering each truss assembly forming the several module walls W, each truss plane is at an oblique angle with respect to the plane defined by the series of inner chords 1 (or to a plane defined by the series of outer chords 2). Since the direction of load exerted on the module is perpendicular to the above-defined two planes, the oblique arrangement of the trusses with respect to these planes thus provide for a statically self-bracing arrangement for such trusses.

Further, the particularly designed transitional zone (hunch H) between each module wall W, as described above, provides a great stability of the module structure in the connecting zones between two module walls W. Such a stability is of particular importance, since from the statical point of view the hunches H contain the mutual support points of the adjoining truss assemblies forming the particular hunch H.

It is noted that in the illustrated example, each truss assembly is formed of four trusses T juxtapositioned in the width direction a. It is to be understood that while the number of trusses in the truss assemblies of a module is always identical, except when openings in the wall are desirable, in which case some trusses might be omitted from the assembly, such number may vary under wide limits according to requirements.

While the above-described, particularly structured transition from one module wall to the other by itself represents a significant improvement in the stability (fixity) of the wall corner regions, according to the invention this stability is further improved by the provision of a transverse connecting member, such as a strut 6 which extends in each transitional zone and which coincides with the line of intersection between a first inner assembly plane defined by the inner chords 1 of one truss assembly (forming one module wall W) and a second inner assembly plane defined by the inner chords 1 of the adjoining truss assembly (forming an adjoining module wall W). The strut 6 is attached to each inner chord 1 it traverses. Thus, the strut 6 is attached alternatingly to the inner chords 1 of the one and the other truss assembly forming the two adjoining module walls W.

It is noted that the transverse connecting members need not be struts 6 but can be replaced by a deck or other statically two-dimensional member which is substantially coextensive with the plane defined by the inner chords of a truss assembly. In addition to the strut 6, each or some of the hunches H may be further reinforced by the provision of transverse connecting members such as struts 7 and 8 interconnecting, in each truss assembly, the end points of the outer chords 2. Struts 7 and 8 lie essentially in the hunch plane. The provision of struts 7 and 8 is of particular importance in case some of the trusses are omitted as indicated earlier.

While the module described in connection with FIG. 1 is of the closed type and, because of the particular geometry of the truss assemblies and their interconnection, the walls must be of even number in such closed modules, the invention also encompasses "open" modules such as the module M' shown in FIG. 4. In this four-sided module, unlike in the structure shown in FIG. 1, no bottom wall exists; it is formed of two parallel side walls $W_a$ and two upwardly converging roof walls $W_b$. The accordion-like truss assemblies forming each wall are not shown.

It is thus to be understood that the module according to the invention may be open or closed and may be formed of a desired number of walls (but wherein the closed—polygonal—modules must have walls of even number and not less than four).

Turning now to FIG. 3, it is advantageous to provide, as the inner chords and the outer chords of the trusses T, bars having an L cross section, in which the web members of the latticework are attached to the inner face of the angle and the plane in which the latticework lies (truss plane) is at an oblique angle to the plane of either leg of the L-section. By virtue of such a truss structure, two adjoining trusses in the truss assembly have their parallel-extending adjoining chords in a back-to-back relationship in which the two angles form a T when viewed in cross section. This arrangement is particularly advantageous in that it lends itself readily for the support of a planar deck or skin member on either side of the module wall since the top face of the T's define flat support areas which lie in a single plane.

Figure 6:
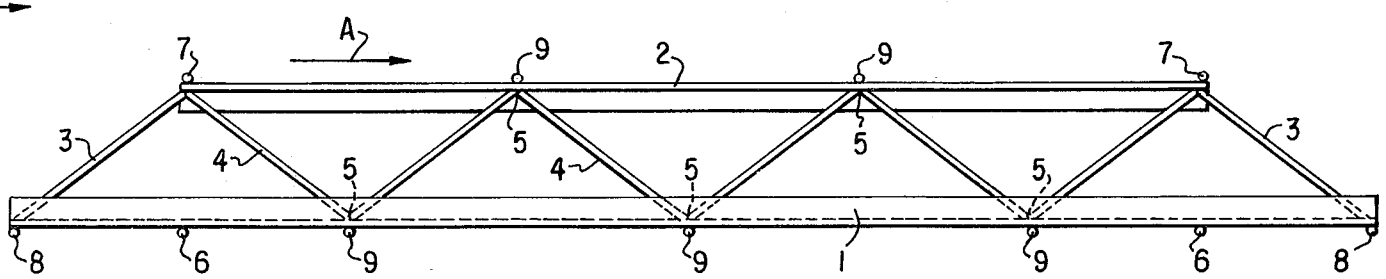
FIG. 6 is a side elevational view of the structure shown in FIG. 5.

FIGS. 5 and 6 are top plan and side elevational views of a modified truss assembly which may constitute one wall of the module M of FIG. 1. In addition to the strut 6, or in addition to the struts 6, 7 and 8 as discussed earlier, there are provided additional transverse connecting members such as struts 9 provided on both sides of the truss assembly. It is an essential feature of this arrangement that all the struts 9 pass through panel points 5, regardless of whether the particular strut 9 connects the inner chords 1 or the outer chords 2. While it is feasible to provide struts 9 only through some of the panel point series which extend perpendicularly to the chords 1 or 2, it is essential that wherever a strut 9 is attached to a panel point 5 associated with any selected web member 4, there should be a strut 9 attached to the other panel point 5 associated with the same selected web member 4. It is noted that the rod-like struts 9 may be replaced by a statically equivalent contiguous deck extending generally in the plane which is defined by the inner chords 1 or in the plane which is defined by the outer chords 2. By providing the transverse connecting members 9 that rigidly couple together, in a direction perpendicular to the chords 1 or 2, panel points 5, the truss assembly is converted, according to the invention, into a space frame which has a primary and a secondary truss system consisting, respectively, of primary trusses and secondary trusses.

The primary truss system of the space frame illustrated in FIGS. 5 and 6 is constituted by the trusses T which thus constitute primary trusses. The truss plane of each primary truss extends parallel to the direction of the arrow A. The secondary truss system comes into being by the provision of the transverse connecting members 9 for these reasons: as explained above, a transverse connecting member (strut) 9 is attached to those locations of consecutive chords 1 and consecutive chords 2 which are touched by a web member 4 of the consecutive primary trusses T. Thus each strut 9 can itself be considered as a chord of a secondary truss, the latticework of which is formed of web members 4 of consecutive primary trusses viewed in a direction perpendicular to the chords of the primary trusses. Thus, the truss plane of each secondary truss extends parallel to the direction of the arrow B. While the primary truss system performs primarily a load bearing function, the role of the secondary truss system is principally that of load distribution. Such a provision of load distribution by means of the secondary truss system is of particular advantage, for example, in case there is a truss failure, or elimination of a truss in the primary truss system. The secondary truss system ensures redistribution of the load bearing function of the faulty truss to the remaining primary trusses of the primary truss system. If trusses are to be eliminated for convenience, the secondary truss in that area can act as a transfer truss redistributing the load bearing function of the eliminated trusses.

As may be observed in FIGS. 1, 5 and 6, within each module wall (truss assembly) there are provided a plurality of parallel, unobstructed (that is, throughgoing), continuous air spaces which are bounded by the latticework of adjoining trusses. It is added that such air spaces extend both in the direction of the arrow A (FIGS. 5 and 6) in which case they are bounded by the primary trusses, and in the direction of arrow B (FIG. 5) in which case they are bounded by the secondary trusses (viewed in FIG. 6, the latter air spaces extend perpendicularly to the sheet of the drawing).

It is noted that the space frame formed of a primary and a secondary truss system as described in connection with FIG. 5 may be used apart from a housing module, for example, as a flat roof structure supported by columns or bearing walls. It is to be understood that in case such a space frame is utilized for purposes other than a wall of a housing module, the trusses need not be trapezoidal, they can be generally quadrilateral having two parallel sides constituting the chords on the one and the other side, respectively, of the space frame. The struts 6 may also be omitted.

FIG. 7 illustrates a practical embodiment of the struts 6, 7 or 8 in the hunches H of the housing module of FIG. 1 and/or the struts 9 constituting the chords of the secondary truss system of the space frame illustrated in FIGS. 5 and 6. Each strut 10 is formed of a single strut bar 10*a* which extends at right angles to the truss chords and which passes through apertures 11 provided therein. The strut bar 10*a* is, along those length portions which straddle two adjacent trusses, surrounded by separate spacer tubes 10*b*. The two ends of the strut bar 10*a* are provided with a tensioning device such as a nut 12 mounted on threaded ends of the strut bar 10*a*. Thus, by tightening the nuts 12, the strut bar 10*a* is tensioned urging the trusses of the truss assembly to one another. This force is resisted by the spacer tubes 10*b* which are thus exposed to a compressive stress. In this manner, the strut assembly 10 provides for a stressed, stabilizing strut connection.

The assembly of a housing module is effected by connecting together the prefabricated trusses T. Essentially two types of assembling operations may be performed:

According to the first mode of assembling operation, the several trusses constituting one truss assembly (forming one wall of the module) are, from the beginning, fixedly secured (bolted or welded) together to assume their zigzag accordion-like configuration. Two or more module walls may be assembled in this manner; the angle between the truss planes of the trusses T in each truss assembly is determined as a function of the calculated loads, whereas the angle under which adjoining truss assemblies (two module walls) are coupled to one another is determined by the desired shape of the module. It is apparent that there is an interrelationship between the angle defined by adjoining truss planes, the angle defined by adjoining module walls and the length of the short and long chords as well as that of the diagonal chords.

Turning now to FIG. 8, the other mode of assembling operation is based on the principle of pivotal dual folding. In this erection method the trusses are pivotally interconnected to form several truss assemblies which eventually will constitute several module walls. Prior to erection into the final three-dimensional configuration, the trusses are arranged substantially flat on the ground and then all the short chords of one truss assembly are lifted, for example, by a crane or the like. As the entire structure is lifted, gradually the zigzag configuration of the trusses takes shape and simultaneously, adjoining truss assemblies gradually assume their angled relationship with respect to one another to thus constitute the module walls arranged at an angle to one another. It is noted that the principle of such a dual folding of trapezoidal interconnected panel systems is discussed in U.S. Pat. No. 3,854,266 issued Dec. 17th, 1974. Subsequent to arranging the truss assemblies in the desired angular relationship with respect to the truss planes in one truss assembly and with respect to the angle between two adjoining truss assemblies, the strut members 6 are applied along the inneer chords at each hunch H and if desired, there are mounted the additional struts 7 and 8 along the outer chords in each hunch H as well as furrther strut members 9 as described in connection with FIGS. 5 and 6. This mode of assembly is particularly suited for open modules, space frames and each half of the closed modules of 6 or more sides.

A single housing module, for example, of the quadrilateral type shown in FIG. 11 may constitute the entire skeleton (floor, side walls and roof) of a cottage-like, detached building. A single hexagonal module may constitute the entire skeleton of a simple two-story structure by providing a horizontal floor or deck interconnecting two opposite corners of the hexagon. Or, a plurality of modules may be stacked in a variety of patterns. Thus, FIG. 9 schematically shows, in a stacked arrangement, three modules M of the kind illustrated in FIG. 1. In this example, the stacking is corner-to-corner which is made possible by the provision of the hunch H at each corner of each module. FIG. 10 illustrates schematically three hexagonal modules in a stacked relationship; in this example the middle (raised) module is supported at one wall face. It can be further observed that by means of a staggered stacking as shown in FIGS. 9 and 10, the useful space is increased, since, for example, below the raised module a space is formed which may be utilized similarly to the other module volumes. According to a further building possibility, a vertical core structure is built and the modules are cantilevered from the core structure in a multi-story arrangement.

Summarizing the advantages of the housing modules structured according to the invention, it is seen that a self-bracing assembly is obtained as soon as the trusses are affixed to one another in the accordion-like (zigzag) configuration and, accordingly, no scaffolding or other auxiliary bracing structure is needed during the erection of the modules. Further, the particular chamferred configuration of the transitional zone (hunch H) between each module wall (enhanced by the strut member in the hunch zone extending inside of the module along the line of intersecton between the planes defined by the inner chords of the one and the other module wall) ensures a superior stability (fixity) in the corner zones of the modules. The particular hunch zones provide further that the stacking possibilities of the modules is substantially increased since a staggered stacking with the hunches as the support zones may be effected. Continuity of mechanical and electrical items from one module to another can also be achieved through this hunch.

Further according to the invention in any space frame the transverse connecting members (6 through 9) on either the one or the other side of the space frame may be replaced by a rigid deck (or skin), while the struts on the other side of the space frame remained unchanged thus, for example, in the space frame of FIGS. 5 and 6 a rigid deck may be secured to the chords 2, replacing the struts 7 and 9 associated with the chords 2.

It is to be understood that the above description of the present invention is susceptible to various modifications, changes and adaptations, and the same are intended to be comprehended within the meaning and range of equivalents of the appended claims.

What is claimed is:

1. A rigid housing module formed of a plurality of module walls connected to one another at a predetermined angle other than 0° and 180°; the improvement wherein each module wall has (a) an assembly of identical planar structural elements each having the shape of a trapezoid; each said element having a relatively long inner side constituting the long base of the trapezoid, a relatively short outer side constituting the short base of the trapezoid and two diagonal sides constituting the two non-parallel sides of the trapezoid; said inner and outer sides and said diagonal sides enclosing a quadrilateral area defining an element plane; the said inner sides of the elements in each said assembly lying in one plane constituting an inner assembly plane; the elements of each assembly being arranged in a juxtapositioned series wherein all said inner and outer sides are parallel to one another and wherein adjoining elements are connected to one another alternatingly along adjoining outer sides and along adjoining inner sides and further wherein said elements are in a zigzag arrangement and each said element plane is oriented at a predetermined oblique angle with respect to said inner assembly plane; adjoining module walls being connected to one another along adjoining, parallel-extending diagonal sides of the elements forming two said assemblies that constitute two adjoining module walls; each outer side and each inner side in any one said assembly continuing as an inner side and as an outer side, respectively, in any adjoining said assembly; and (b) rigid transverse connecting means extending along each line of intersection formed between the inner assembly planes of said assemblies; each said rigid transverse connecting means being attached to each said inner side it traverses along the respective said line of intersection.

2. A rigid housing module as defined in claim 1, wherein the planar structural elements are trusses each having an inner chord constituting said inner side, an outer chord constituting said outer side, two diagonal chords constituting said diagonal sides and a latticework occupying said quadrilateral area and being formed of a plurality of web members each connecting said outer chord with said inner chord.

3. A rigid housing module as defined in claim 2, wherein each said web member is attached to the respective inner chord at a first panel point and to the respective outer chord at a second panel point; said first panel points being arranged in a plurality of parallel-spaced first series; each said first series being parallel to and spaced from said lines of intersection in the respective assembly; said second panel points being arranged in a plurality of spaced second series each extending parallel to said first series; further comprising first additional rigid transverse connecting means forming part of at least one of said assemblies and being attached to the first panel points of at least one of said first series; and second additional rigid transverse connecting means forming part of said at least one assembly and being attached to the second panel points of at least one of said second series; to each said first additional rigid transverse connecting means attached to the first panel point associated with any selected web member, there corresponds a said second additional rigid transverse connecting means attached to the second panel point associated with said selected web member.

4. A rigid housing module as defined in claim 2, wherein said inner chords and said outer chords are of L-shaped cross section and wherein adjoining inner chords and adjoining outer chords are arranged back-to-back to form a T when viewed in cross section and further wherein outer faces of each said outer chord and each said inner chord in the assemblies lie in respective single planes.

5. A rigid housing module as defined in claim 1, further comprising a first additional rigid transverse connecting means being attached to ends of each said outer side of said elements in at least one of said assemblies adjacent to least one of said lines of intersection in a direction parallel to said at least one line of intersection; and a second additional rigid transverse connecting means being attached to ends of each said outer side of said elements in the assembly adjacent said at least one assembly in a direction parallel to said at least one line of intersection and closest to said at least one line of intersection.

6. A rigid housing module as defined in claim 1, 2, 3 or 5, wherein at least one of the connecting means comprises a strut extending parallel to the direction of said lines of intersection.

7. A rigid housing module as defined in claim 6, wherein the strut comprises a strut bar passing through apertures in the elements and having opposite ends projecting beyond opposite ends of the respective assembly; means for tensioning said strut bar at its ends and a plurality of tubular spacers surrounding said strut bar and straddling and engaging adjoining elements in the assembly.

8. A rigid housing module as defined in claim 1, wherein said module has the outline of a closed polygon having sides of even number; each side of the polygon being constituted by one of said module walls.

9. A rigid housing module as defined in claim 2, wherein adjoining trusses of the same assembly have a single inner chord common to both adjoining trusses.

10. A rigid housing module as defined in claim 2, wherein adjoining trusses of the same assembly have a single outer chord common to both adjoining trusses.

11. A rigid housing module as defined in claim 2, further comprising a rigid, deck-like member extending substantially in said inner assembly plane and being affixed to at least some of said inner chords; said deck-like member constituting said rigid transverse connecting member.

12. A rigid housing module as defined in claim 1, wherein the long sides in one assembly project beyond the respective short sides of an adjoining assembly for providing an overhung module wall constituted by said one assembly.

13. A rigid housing module as defined in claim 2, wherein any two adjoining trusses belonging to separate, adjoining assemblies having a single diagonal chord common to both adjoining trusses.

14. A rigid housing module as defined in claim 1, wherein the short sides in one assembly project beyond the respective long sides of an adjoining assembly for providing an overhung module wall constituted by said one assembly.

15. A rigid space frame comprising in combination:

(a) a plurality of identical quadrilateral trusses each having opposite parallel first and second chords, opposite third and fourth chords and a latticework occupying the area enclosed by said chords; said area defining the truss plane; a latticework being formed of a plurality of web members each connecting said first chord with said second chord at locations constituting first panel points on said first chord and second panel points on said second chord; said first panel points forming a plurality of parallel-spaced first panel point series extending perpendicularly to said first chord and said second panel points forming a plurality of parallel-spaced second panel points series extending perpendicularly to said second chords; said plurality of identical trusses being arranged in a juxtapositioned series, wherein all said first and second chords are parallel to one another and wherein adjoining trusses are connected to one another alternatingly along adjoining first chords and along adjoining second chords and further wherein said trusses are in a zigzag arrangement; each said truss plane being oriented at a predetermined oblique angle with respect to a plane defined by said first chords; said first chords and said second chords being of L-shaped cross section and adjoining first chords and adjoining second chords being arranged back-to-back to form a T when viewed in cross section and outer faces of each said first chord and each said second chord lying in respective single planes;

(b) first rigid transverse connecting means being attached to the first panel points of at least one of said first panel point series; and (c) second rigid transverse connecting means being attached to the second panel points of at least one of said second panel points series; to each said first additional rigid transverse connecting means attached to the first panel point associated with any selected web member there corresponds a said second rigid transverse connecting means attached to the second panel point associated with said selected web member.

16. A rigid space frame comprising in combination:

(a) a plurality of identical quadrilateral trusses each having opposite parallel first and second chords, opposite third and fourth chords and a latticework occupying the area enclosed by said chords; said area defining the trusss plane; a latticework being formed of a plurality of web members each connecting said first chords with said second chord at locations constituting first panel points on said first chord and second panel points on said second chord; said first panel points forming a plurality of parallel-spaced first panel point series extending perpendicularly to said first chord and said second panel points forming a plurality of parallel-spaced second panel point series extending perpendicularly to said second chords; said plurality of identical trusses being arranged in a juxtapositioned series, wherein all said first and second chords are parallel to one another and wherein adjoining trusses are connected to one another alternatingly along adjoining first chords and along adjoining second chords and further wherein said trusses are in a zigzag arrangement; each said truss plane being oriented at a predetermined oblique angle with respect to a plane defined by said first chords; each chord including longitudinally extending first and second legs adjoining one another longitudinally in a mutually perpendicular relationship; said first and said second legs together having an L-shaped cross section; the first legs of adjoining first chords and adjoining second chords being arranged in a back-to-back contacting relationship whereby the first and second legs of adjoining chords form a T when viewed in cross section; outer faces of the second legs of each said first chord and each said second chord lying in respective single planes;

(b) first rigid transverse connecting means being attached to the first panel points of at least one of said first panel point series; and (c) second rigid transverse connecting means being attached to the second panel points of at least one of said second panel point series, to each said first additional rigid transverse connecting means attached to the first panel point associated with any selected web member there corresponds a said second rigid transverse connecting means attached to the second panel point associated with said selected web member.

17. A rigid space frame as defined in claim 16, wherein adjoining trusses have a single said first chord common to both adjoining trusses.

18. A rigid space frame as defined in claim 16, wherein adjoining trusses having a single said second chord common to both adjoining trusses.

19. A rigid space frame as defined in claim 16, further comprising a rigid, dock-like member extending substantially in a plane defined by said first chords and being affixed to at least some of said first chords; said deck-like member constituting said first rigid transverse connecting means.

20. A rigid space frame as defined in claim 16, further comprising a rigid deck-like member extending substantially in a plane defined by said second chords and being affixed to at least some of said second chords; said deck-like member constituting said second rigid transverse connecting means.

21. A rigid housing module as defined in claim 2 or 16, wherein the web members forming part of the same truss are parallel to one another.

22. A rigid space frame comprising in combination: a plurality of identical quadrilateral trusses each having opposite parallel first and second chords, opposite third and fourth chords and a latticework occupying the area enclosed by said chords; said area defining the truss plane; a latticework being formed of a plurality of web members each connecting said first chord with said second chord at locations constituting first panel points on said first chord and second panel points on said second chord; said first panel points forming a plurality of parallel-spaced first panel point series extending perpendicularly to said first chord and said second panel points forming a plurality of parallel-spaced second panel point series extending perpendicularly to said second chords; said plurality of identical trusses being arranged in a juxtapositioned series, wherein all said first and second chords are parallel to one another and wherein adjoining trusses are connected to one another alternatingly along adjoining first chords and along adjoining second chords and further wherein said trusses are in a zigzag arrangement; each said truss plane being oriented at a predetermined oblique angle with respect to a plane defined by said first chords; first rigid transverse connecting means being attached to the first panel points of at least one of said first panel point series; and second rigid transverse connecting means being attached to the second panel points of at least one of said second panel point series; to each said first additional rigid transverse connecting means attached to the first panel point associated with any selected web member there corresponds a said second rigid transverse connecting means attached to the second panel point associated with said selected web member; at least one of the rigid transverse connecting means comprising a strut bar extending perpendicularly to said first and second chords and passing through apertures in consecutive chords; said strut bar having opposite ends projecting beyond opposite ends of the space frame; means for tensioning said strut bar at opposite ends; and a plurality of tubular spaces surrounding said strut bar and straddling and engaging adjacent chords.

* * * * *